United States Patent [19]

Inoue

[11] 4,263,044

[45] Apr. 21, 1981

[54] IRON/CHROMIUM/COBALT-BASE SPINODAL DECOMPOSITION-TYPE MAGNETIC ALLOY

[75] Inventor: Kiyoshi Inoue, Tokyo, Japan

[73] Assignee: Inoue-Japax Research Incorporated, Kanagawaken, Japan

[21] Appl. No.: 27,854

[22] Filed: Apr. 6, 1979

Related U.S. Application Data

[63] Continuation-in-part of Ser. No. 769,268, Feb. 11, 1977, Pat. No. 4,171,978.

[30] Foreign Application Priority Data

Jun. 2, 1978 [JP] Japan ..... 53/67096

[51] Int. Cl.[3] ..... C22C 38/18

[52] U.S. Cl. ..... 75/126 C; 75/126 D; 75/126 E; 75/126 H

[58] Field of Search ..... 75/126 C, 126 D, 126 E, 75/126 H, 134 F

[56] References Cited

U.S. PATENT DOCUMENTS

| | | | |
|---|---|---|---|
| 2,432,614 | 12/1947 | Franks et al. | 75/126 D |
| 2,617,725 | 11/1952 | Owens et al. | 75/134 F |
| 2,848,323 | 8/1958 | Harris et al. | 75/126 D |
| 3,099,128 | 7/1963 | Straumann | 75/126 C |
| 3,588,764 | 6/1971 | Olsen et al. | 75/126 H |
| 3,600,162 | 8/1971 | Kaplan et al. | 75/126 H |
| 3,806,336 | 4/1974 | Kaneko et al. | 75/126 H |
| 3,901,690 | 8/1975 | Philip et al. | 75/126 H |
| 3,954,519 | 5/1976 | Inoue | 75/126 H |
| 3,986,867 | 10/1976 | Masumoto et al. | 75/126 H |
| 4,008,105 | 2/1977 | Yuda et al. | 75/126 H |
| 4,075,437 | 2/1978 | Chin et al. | 75/126 H |
| 4,093,477 | 6/1978 | Iwata et al. | 75/126 H |

FOREIGN PATENT DOCUMENTS

| | | | |
|---|---|---|---|
| 39-15522 | 8/1964 | Japan | 75/126 H |
| 42-19780 | 12/1967 | Japan | 75/126 H |
| 44-20683 | 11/1969 | Japan | 75/126 H |
| 50-101217 | 8/1975 | Japan | 75/126 H |
| 51-5612 | 2/1976 | Japan | 75/126 H |

*Primary Examiner*—L. Dewayne Rutledge
*Assistant Examiner*—John P. Sheehan
*Attorney, Agent, or Firm*—Karl F. Ross

[57] ABSTRACT

A spinodal decomposition type magnetic alloy consisting by weight essentially of 15 to 23% chromium, 10 to 18% cobalt, 0.5 to 4% vanadium, 0.3 to 3% titanium, 0.1 to 2.5% tungsten and the balance iron. The magnetic alloy can be cast into a machinable permanent magnet body and has a high magnetic energy property.

10 Claims, 11 Drawing Figures

I Fe-21Cr-15Co-2V-2Ti-1W
II Fe-21Cr-15Co-3V-2Ti
III Alnico 5DG
IV Alnico 5

IRON/CHROMIUM/COBALT-BASE SPINODAL DECOMPOSITION-TYPE MAGNETIC ALLOY

CROSS REFERENCE TO RELATED APPLICATION

This application is a continuation-in-part of my copending application Ser. No. 769,268 filed Feb. 11, 1977, now U.S. Pat. No. 4,171,978 issued Oct. 23, 1979.

FIELD OF THE INVENTION

This invention relates to an iron/chromium/cobalt-base spinodal decomposition-type magnetic hard alloy and, more particularly, to an improved alloy system which makes possible the production of the magnetic alloy body in a simplified manner while imparting excellent magnetic performance comparable with or even better than those of the alloys of this type heretofore proposed.

BACKGROUND OF THE INVENTION

As pointed out in U.S. Pat. No. 3,806,336 issued Apr. 23, 1974, it is known that the iron/chromium alloy system has, in its composition diagram, a "limit of metastability" or "spinodal" which is thermodynamically defined as the locus of disappearance of the second derivative of the Helmholtz free energy with respect to the composition of the system. When a high-temperature composition, which is of homogeneous single phase structure ($\alpha$-phase), of the alloy is brought within the spinodal in a lower temperature range, it is transformed into a separated two-phase structure ($\alpha_1+\alpha_2$), the phase separation being called "spinodal decomposition". The decomposed alloy has a periodic microstructure generally of the order of hundreds of angstroms and which consists of two composition modulated isomorphous phases in which one phase ($\alpha_1$) is in the form of a fine precipitate uniformly distributed in another phase ($\alpha_2$) which forms the matrix. It is observed that if the first phase in such a microstructure is magnetic and the second is nonmagnetic, there results a single-domain structure whereby a highly retentive magnetic body can be obtained.

The aforementioned U.S. Pat. discloses that the iron/chromium alloy of spinodal decomposition type, when it contains cobalt, optionally also with one or both of molybdenum and tungsten in the proportions set forth therein, represents an improved magnetic-material system whose magnetic retentivity and magnetic energy product are comparable with or generally even higher than those of "Alnico" (iron/aluminum/nickel/-cobalt) alloys which have hitherto been the mainstay of the magnetic industry. In addition to their excellent magnetic properties, the improved alloys have, because of their constituent metals, the advantages of lower material cost and better workability than the conventional alloys. It has also been taught that addition of silicon up to a certain proportion moderates the heat-treatment conditions required to accomplish the spinodal decomposition of the alloys without materially decreasing the desirable magnetic properties attainable therewith. The art has also recognized that the addition of one or more of manganese, nickel, copper and aluminum in a small proportion may be advantageous.

As noted above, the desirable magnetic characteristics of the alloy are imparted when the high-temperature homogeneous single phase, i.e. $\alpha$-phase, decomposes into the two isomorphous phases i.e. the $\alpha_1$ and $\alpha_2$ phases, through the spinode. Accordingly, the method of preparing a magnetic body of the improved alloy system essentially comprises the procedures required to effect the spinodal decomposition of the alloy of a preselected composition. The composition may be prepared by melting constituent metals or components together in a suitable furnace or crucible and then casting the melt to form ingots. While such ingots may, after machining to a suitable dimension, be subjected directly to the treatment procedures, it is possible to convert the alloyed ingot into a powder and then to compact and sinter the particles to a coherent body of a desired geometry. In order to effect the spinodal decomposition, while a gradual cooling may be employed to transform the alloy from the high-temperature to the isomorphous phase through the miscibility gap area, the following steps have been found more practical and highly suitable. The initial step comprises the solution treatment which includes heating at an elevated temperature for a substantial period of time and subsequent quenching to bring the homogenized high-temperature $\alpha$ phase to room temperature. The quenched body is then tempered or aged whereby the spinodal decomposition to $\alpha_1$ and $\alpha_2$ phases is obtained. The solution treatment may be preceded by hot or cold working. The tempering is preferably done stepwise at different temperatures. The solution-treated body is preferably subjected to an isothermal treatment in a magnetic field prior to the final tempering treatment. Magnetic properties of the body are generally improved when a cold working step is incorporated prior to the final quenching step and subsequent to a preliminary tempering step or the magnetic treatment step.

With the prior compositions, however, to accomplish the solution treatment successfully and thus to form the homogeneous single phase $\alpha$ and bring the same to room temperature or aging temperature requires heating to as high as 1300° C. and subsequent quenching at a cooling rate as high as 200° C./sec. Heating to such a high temperature is also required when hot working of the alloy ingot is to be done preparatory to the solution treatment. While, as taught in the aforementioned U.S. Patent, the quenching rate can be lowered substantially by having the alloy contain silicon in the range as specified, the high-temperature heating requirements have imposed great difficulties in the manufacturing process and left much to be desired on the economy of the product magnets.

In order to overcome these difficulties, efforts have been made to explore a further component or components effective to extend the domain of the homogeneous $\alpha$ phase of the alloy system thereby enabling the alloy to be solution-treated and hot-worked at a lower, more practical temperature than the conventional composition while retaining excellent magnetic properties and an improved cold-workability. Thus, for example, in U.S. Pat. No. 3,954,519 issued May 4, 1976, there has already been disclosed an improved spinodal decomposition type alloy of the class described which by weight consists of essentially 3 to 20% cobalt, 10 to 40% chromium, 0.2 to 5% of one or both of niobium and tantalum, 0. to 5% aluminum and the balance iron. As taught therein, the addition of one or both of niobium and tantalum, preferably also with 0.2 to 5% aluminum is effective to extend the domain of the $\alpha$ phase while reducing the $\gamma$ phase of the alloy system, thus making it possible to accomplish the solution treatment at a temperature as low as 900° C. or even about 650° C. depending upon the relative alloy compositions.

The above proposed alloy has, however, still drawbacks arising from the fact that it to be effective or for better results commonly requires the addition of aluminum besides niobium and/or tantalum. A melt of the alloy to which aluminum is added gives rise to handling difficulties in casting and tends to yield irregular products. Moreover, while the use of the best process parameters and compositions has allowed the alloy to achieve a maximum energy product, as high as $5.7\times10^6$ G.Oe, (with cold working) and $4.7\times10^6$ G.Oe (without cold working), the magnetic performance typically attainable by procedures currently adoptable for mass production is limited to $4\times10^6$ G.Oe or less and cannot be said to be satisfactory.

In my U.S. patent application Ser. No. 769,268 filed Feb. 11, 1977, now U.S. Pat. No. 4,171,978 issued Oct. 23, 1979 there has been provided an improved composition for an iron/chromium/cobalt-base spinodal decomposition type magnetic alloy whereby the aforementioned problems associated with the compositions proposed heretofore are substantially reduced or eliminated. Specifically, the improved alloy described therein consists of essentially 3 to 30% by weight cobalt, 10 to 40% by weight chromium, 0.1 to 15% by weight vanadium and the balance iron.

It has been found that addition of vanadium is effective to extend the domain of $\alpha$ phase while diminishing the domain of $\gamma$ phase, of the iron/chromium/cobalt-base alloy system, to improve the magnetic properties and yet to retain a melt of the alloy under satisfactory conditions for casting.

It is desired to reduce cobalt and chromium contents which are both relatively expensive in the Fe-Cr-Co base magnetic alloy with its magnetic properties retained as desire or, if possible, further enhanced.

OBJECT OF THE INVENTION

It is accordingly the object of the present invention to improve the magnetic alloy basically described in the aforementioned copending application and to provide an improved magnetic composition having chromium and cobalt contents which are relatively low in proportion, yet capable of exhibiting superior magnetic properties, i.e., a residual flux density, a coercive force and a maximum energy product while being high in magnetic stability and rendering itself ready to heat treatment while being excellent in workability and machinability.

DESCRIPTION OF THE INVENTION

In accordance with this invention, there is thus provided an improved spinodal decomposition-type magnetic alloy which by weight consists of essentially 15 to 23% chromium, 10 to 18% cobalt, 0.5 to 4% vanadium, 0.3 to 3% titanium, 0.1 to 2.5% tungsten and the balance iron.

A typical favorable composition of the magnetic alloy according-to the invention consists of 21% by weight chromium, 15% by weight cobalt, 2% by weight vanadium, 2% by weight titanium, 1% by weight tungsten and the balance iron. Such an alloy suitably heat-treated is capable of exhibiting a residual flux density of 14.6 K Gauss, a coercive force of 645 Oersted and a maximum energy product of 7.1 M Guass-Oersted. In Table 1 below, there are shown magnetic properties of this typical composition of the alloy of this invention in comparison with those of prior Fe-Cr-Co base alloy compositions and those of Alnico-5.

TABLE 1.

| No. | Composition | Br KG | Hc Oe | (BH)max MGOe |
|---|---|---|---|---|
| 1. | Fe-30Cr-25Co-3Mo | 11.5 | 780 | 5.0 |
| 2. | Fe-30Cr-23Co-3Mo-2Zr | 10.0 | 1100 | 4.5 |
| 3. | Fe-28Cr-23Co-1Si | 13.0 | 580 | 5.3 |
| 4. | Fe-28Cr-15Co-1Nb-1Al | 13.0 | 520 | 5.0 |
| 5. | Fe-21Cr-15Co-3V-2Ti | 14.4 | 570 | 6.2 |
| 6. | Fe-28 ~ 30Cr-17 ~ 24Co-1Si | 12.0 | 600 | 4.5 ~ 5.5 |
| | | ~13.0 | ~700 | |
| 7. | Fe-14Ni-8Al-24Co-3Cu | 12.3 | 580 | 4.5 ~ 5.5 |
| | | ~13.3 | ~660 | |
| 8. | Fe-21Cr-15Co-2V-2Ti-1W | 14.6 | 645 | 7.1 |

From this is seen that the alloy according to the invention is markedly superior especially in maximum energy product to those previously proposed.

The alloy according to this invention may be considered to represent an addition of tungsten to a particular prior composition of the quinary alloy: Fe/Ce/Co/V-/Ti. Table 2 below shows how the coercive force Hc of the latter alloy is affected by addition of various sixth additional elements.

TABLE 2

| Additive (1%) | Coercive Force Hc (Oe) Base Alloy Fe-21Cr-15Co-3V-2Ti | Fe-21Cr-15Co-2V-2Ti |
|---|---|---|
| None | 570 | — |
| Al | 100 | 240 |
| Si | 560 | 490 |
| Zr | 590 | 570 |
| Nb | 580 | 480 |
| Mo | 550 | 630 |
| Ta | — | 570 |
| W | 640 | 650 |

This table shows that the addition of tungsten to the particular Fe/Cr/Co/V/Ti alloy produces a marked increase in coercive force to an extent not obtainable with the other sixth additional elements.

BRIEF DESCRIPTION OF THE DRAWING

This invention will be described hereinafter, for illustrative purposes, hereinafter, with reference to the accompanying drawing in which.

SPECIFIC DESCRIPTION

Figure 1:
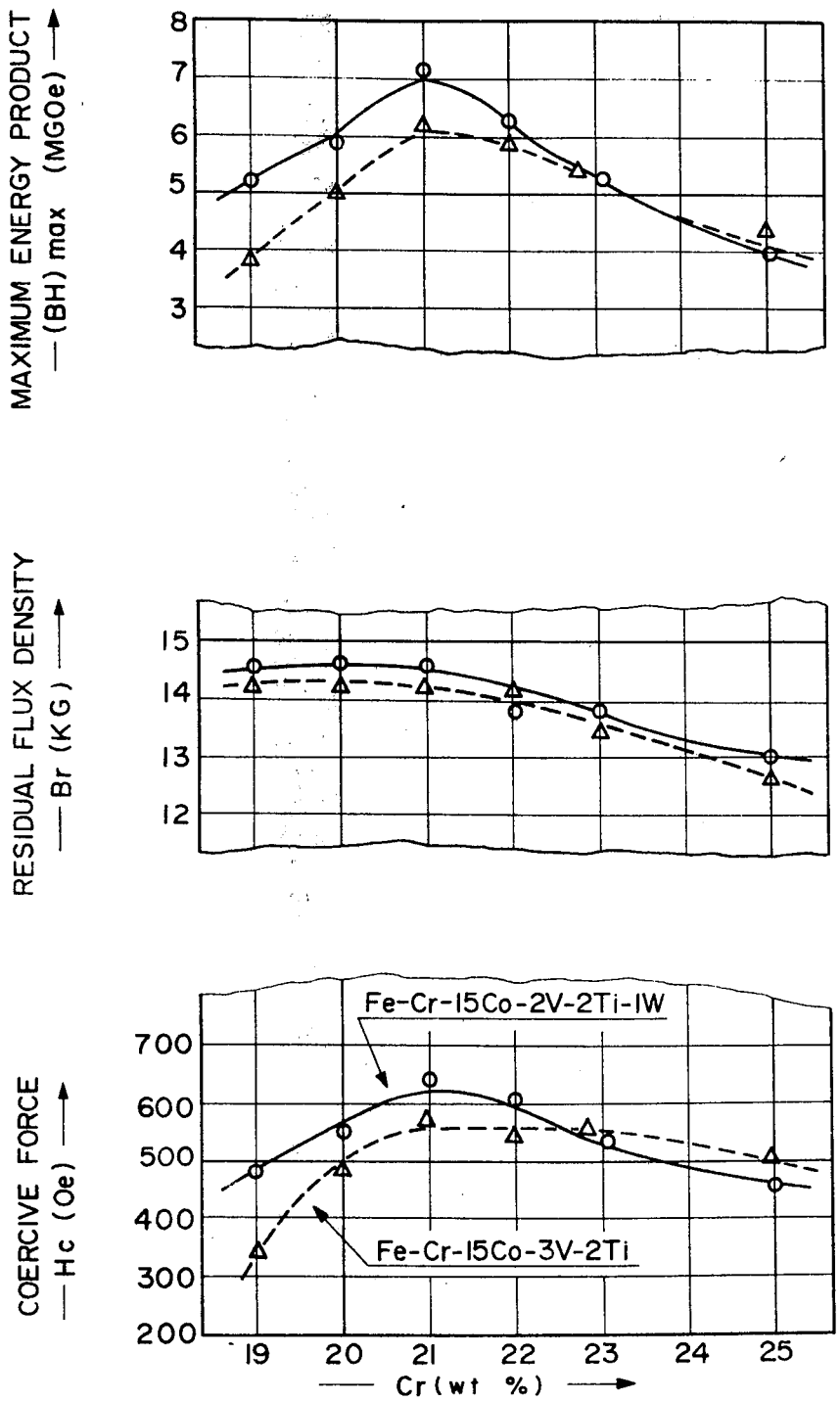
FIG. 1 is a graphical representation showing magnetic properties of a certain composition of the alloy of the invention and those of the alloy without tungsten versus the proportion of chromium component.

From FIG. 1 it is seen that an iron-chromium-15% cobalt-2% vanadium-2% titanium-1% tungsten sixinary alloy (proportions shown in weight percent throughout the specification) embodying the present invention with the chromium content of 19 to 23% is markedly better than an iron-chromium-15% cobalt-3% vanadium-2% titanium quinary alloy with the varying chromium content in the same range in magnetic properties all in terms of coercive force, Hc (Oersted), residual flux density Br (Kilo-Gauss) and maximum energy product (BH)max (MGOe). The most favorable proportion of chromium in terms of maximum energy product is seen to range between 20 to 22% and lie especially at about 21%. Furthermore, it is seen that the effect of the addition of tungsten to enhance the coercive force Hc is great in the region of lesser chromium content and the lower limit of chromium can be set at approximately 15%.

Figure 2:
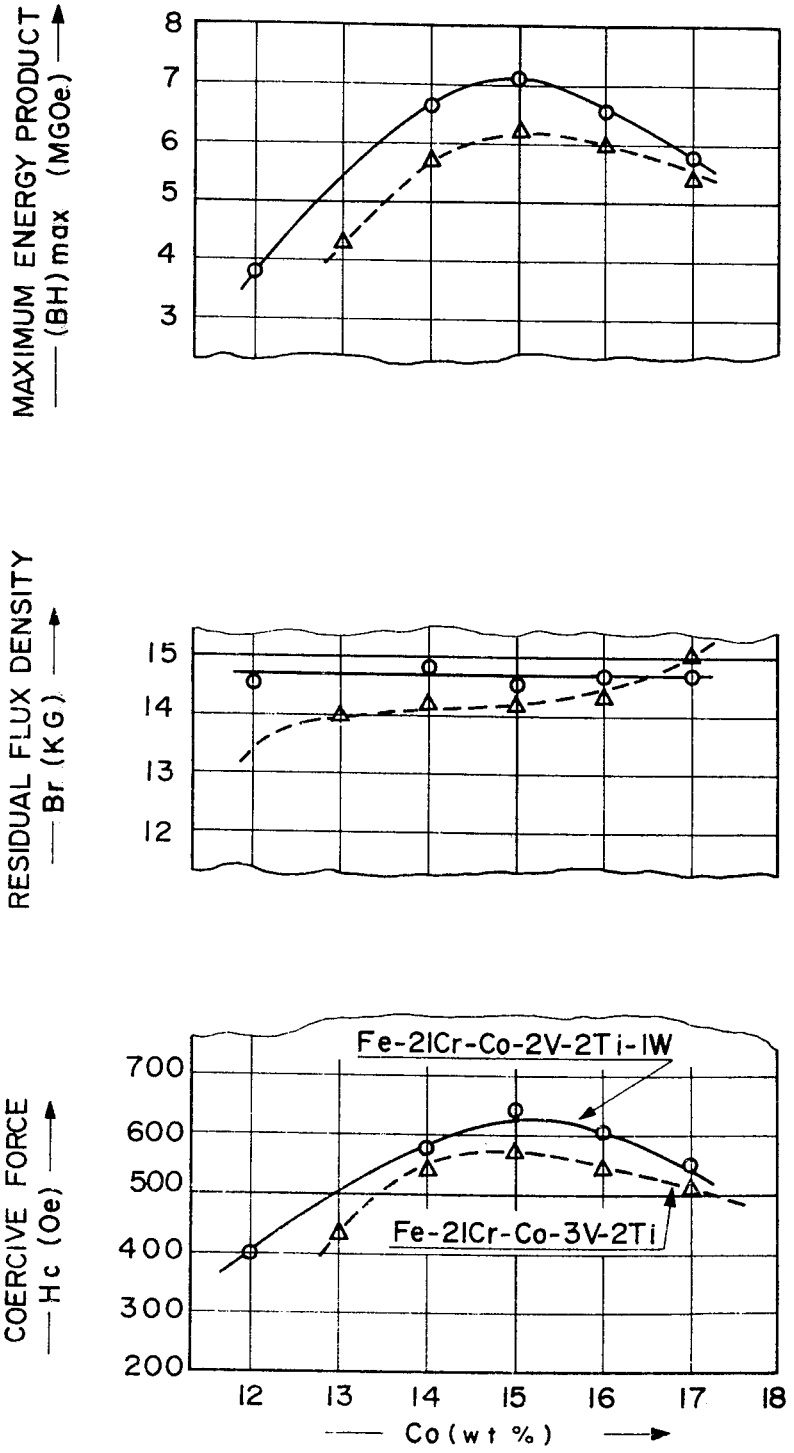
FIG. 2 shows in the similar graphical representation and respective magnetic properties of the same two compositions versus the proportion of cobalt component.

From FIG. 2 it is seen that an iron-21% chromium-cobalt-2% vanadium-2% titanium-1% tungsten sixinary alloy with the cobalt content of 12 to 18% is markedly better than an iron-21% chromium-cobalt-3% vanadium-2% titanium quinary alloy with the varying cobalt content in the same range all in terms of coercive force Hc (Oersted), residual flux density Br (Kilo-Gauss) and maximum energy product (BH) max (MGOe). It is also seen that with lesser cobalt content, greater enhancement of both coercive force and maximum energy product results by the addition of tungsten component. Thus, the cobalt content may have a lower limit of 10% and an upper limit of 18%, preferably 17%. A preferred range of cobalt may be between 13 and 17%, preferably around 15%.

From FIGS. 1 and 2 and for the reasons stated above, it is appreciated that a sixinary Fe-Cr-Co-2V-2Ti-W alloy embodying the present invention should have preferably the chromium content in the range between 15 and 23%, preferably between 20 and 23% and the cobalt content in the range between 10 and 18%, preferably between 13 and 17%.

With the chromium content falling below 15% and exceeding 25% or with the cobalt content falling below 10% and exceeding 18%, the alloy does not yield desired values of magnetic properties, expecially of maximum energy product. This notwithstanding, it should be noted that the use of the alloy permits its cobalt and chromium contents to lie in extended ranges, thus to extend their lower limits, say, down to 5% and 10%, respectively.

Figure 3:
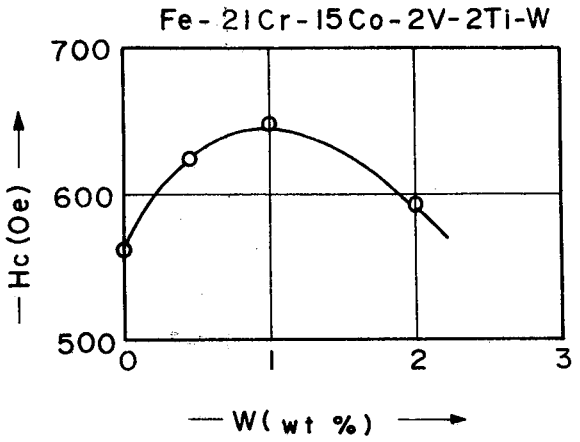
FIG. 3 shows the coercive force Hc of sixinary Fe-21Cr-15Co-2V-2Ti-W alloy versus the proportion of tungsten component.

FIG. 3 shows that in the sixinary Fe-21Cr-15Co-2V-2Ti-W alloy, the addition of tungsten in the proportion of 0.1 to 2.5%, preferably between 0.2 and 2.0% and most desirably around 1%, is effective and its excessive addition beyond, say, 2.5% is disadvantageous.

Figure 4:
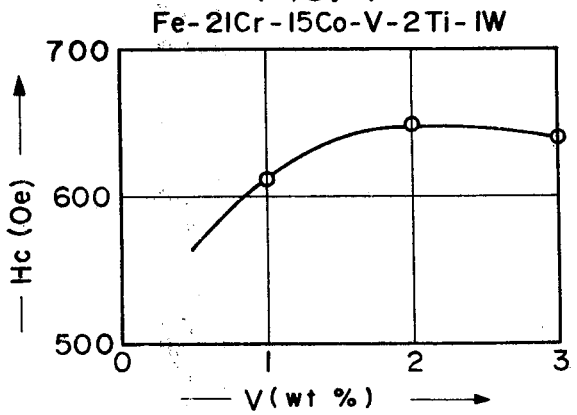
FIG. 4 shows the coercive force of sixinary Fe-21Cr-15Co-V-2Ti-1W alloy versus the proportion of vanadium component.

FIG. 4 shows that in the sixinary Fe-21Cr-15Co-V-2Ti-1W alloy, the vanadium content should effectively range between 0.5 and 4%, preferably between 1 and 3%.

Figure 5:
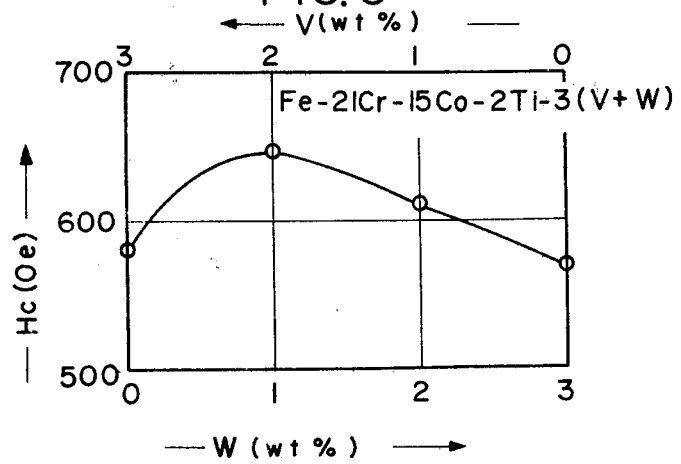
FIG. 5 shows the coercive force of sixinary Fe-21Cr-15Co-2Ti-3(V+W) alloy versus proportions of vanadium and tungsten components.

FIG. 5 shows that in sixinary Fe-21Cr-15Co-2Ti-V-W alloy containing vanadium and tungsten components in the total amount of 3%, the vanadium component may be effectively included in an amount between 0.5 and 3%, preferably between 1 and 3% and most desirably around 2%. It thus indicates that the addition of tungsten component should range not greater than 2.5%, preferably between 0.2 and 2.0% and most desirably around 1%.

Figure 7:
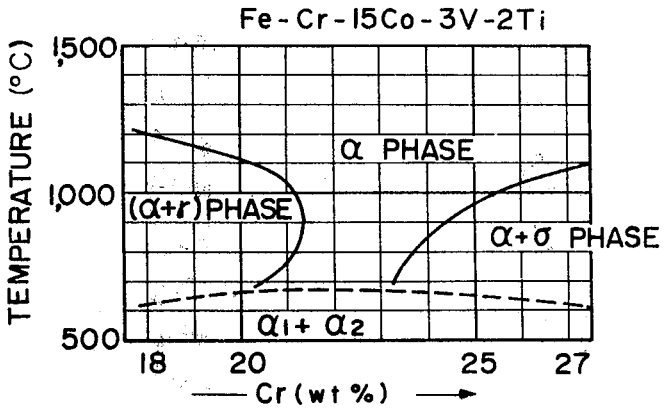
FIG. 7 shows a quasi-stable sectional phase diagram of quinary Fe-Cr-15Co-3V-2Ti alloy with the content of chromium component varied.

The content of the final additive titanium is determined not much in consideration of magnetic improvement but for reasons of ease of casting, heat treatment and machining of the alloy. It has been known that addition of titanium facilitates the fluidity of a melt and is capable of effectively decreasing the temperature for solutioning of the cast below 1300° C. and advantageously down to 1200° C. Titanium plus vanadium can be advantageously added to an iron/chromium/cobalt base alloy, say Fe/21Cr/15Co to extend the $\alpha$-phase of the base alloy as attained by addition of niobium plus aluminum, yet without embrittling the cast body as in the case of the latter. FIG. 7 shows that with added titanium plus vanadium, the Fe-Cr-15Co alloy with chromium content between 21.5 and 23% possesses the single $\alpha$-phase which can be transformed into $\alpha_1$ and $\alpha_2$ phases without quenching. This chromium range is slightly shifted with the simultaneous addition of tungsten as is apparent from FIG. 8 to hold the desired single $\alpha$-phase. In this case, the amount of vanadium plus titanium should effectively be at or in excess of 0.3% and not greater than 3% beyond which the alloy deteriorates in both fluidity and machinability.

Figure 6:
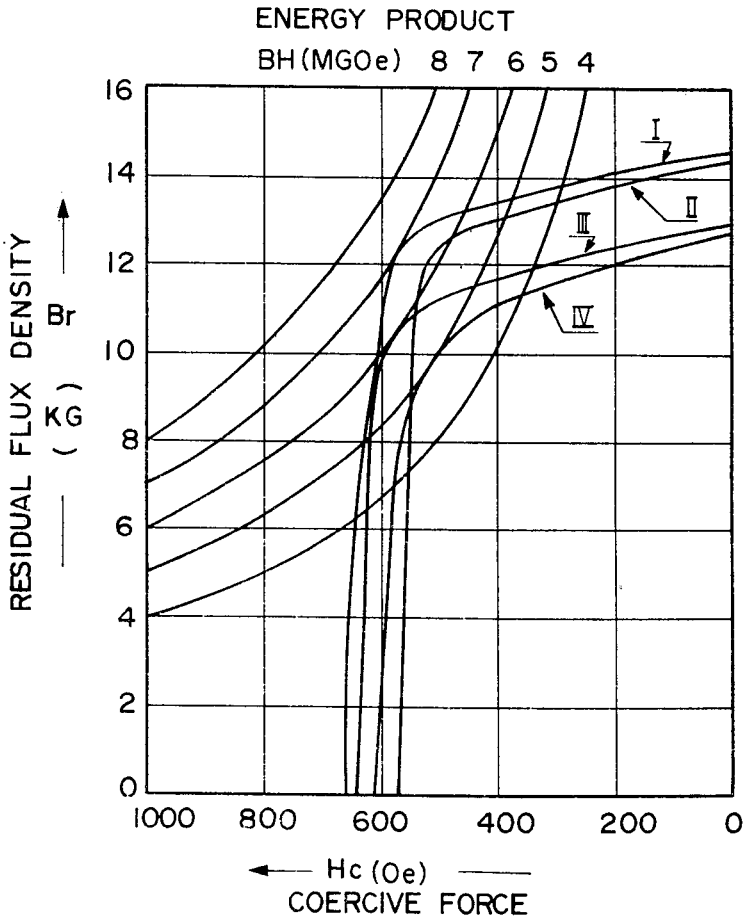
FIG. 6 is a graph showing a hysteresis curve of sixinary Fe-21Cr-15Co-2V-2Ti-1W alloy as well as those of other, prior alloys.

In FIG. 6, there is shown a hysteresis curve I of Fe-21Cr-15Co-2V-2Ti-1W, a typical and favorable composition of the alloy of this invention, in comparison of hysteresis curves II, III and IV of earlier alloys Fe-21Cr-15Co-3V-2Ti, Alnico 5DG and Alnico 5, respectively. It is demonstrated that the alloy according to the invention markedly exceeds the prior alloys in maximum energy product.

Figure 8:
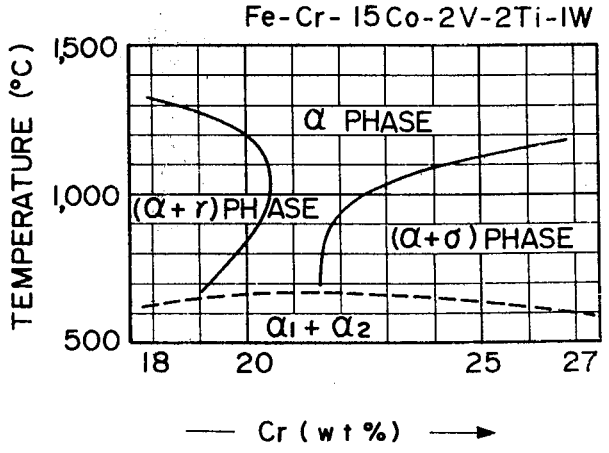
FIG. 8 shows a quasi-stable sectional phase diagram of of sixinary Fe-Cr-15Co-2V-2Ti-1W alloy with the content of chromium component varied.
Figure 9:
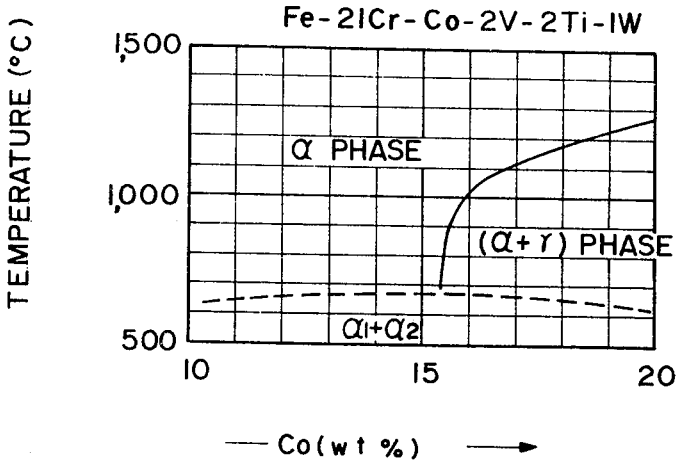
FIG. 9 shows a quasi-stable sectional phase diagram of sixinary Fe-21Cr-Co-2V-2Ti-1W alloy with the content of cobalt varied.

From FIGS. 8 and 9, it is seen that the composition according to the invention, say, Fe-21Cr-15Co-2V-2Ti-1W is capable of undergoing spinodal decomposition with readiness under suitable heat treatment procedures.

Figure 10:
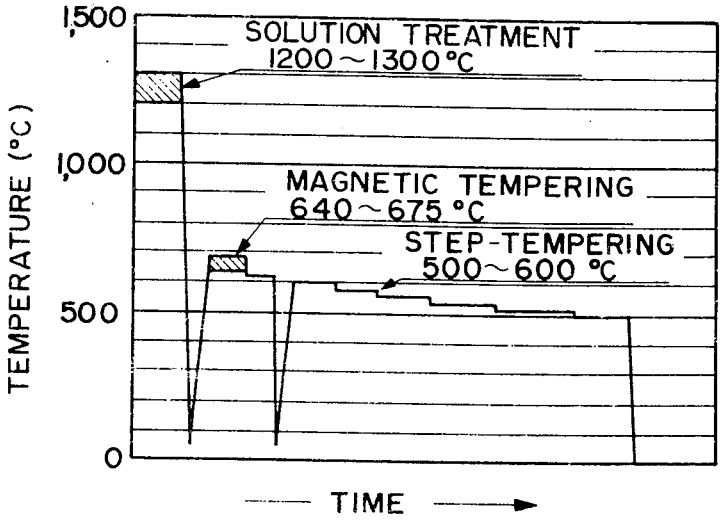
FIG. 10 is a graphical representation illustrating preferred heat-treatment steps utilized in the practice of this invention.
Figure 11:
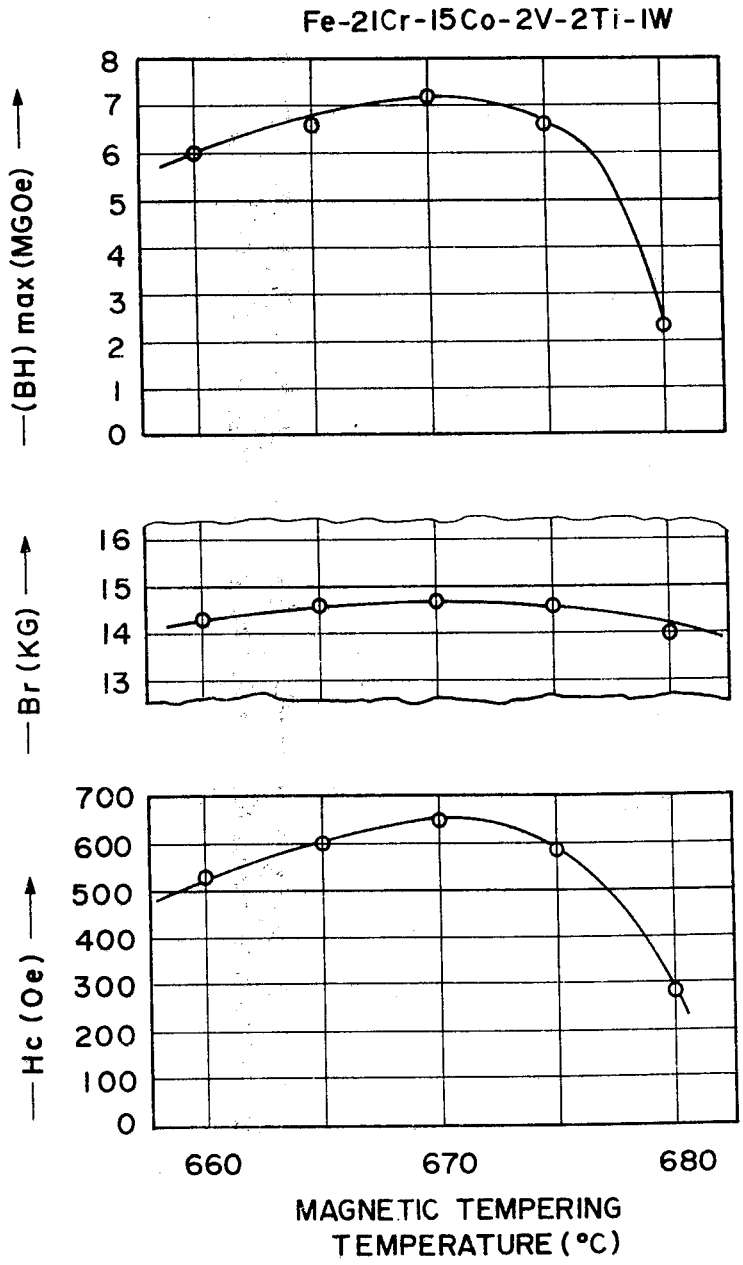
FIG. 11 is a graphical representation illustrating the temperature of magnetic tempering treatment affecting on the magnetic proportion of sixinary Fe-21Cr-15Co-2V-2Ti-1W alloy.

In FIG. 10, there is shown a typical heat-treatment produre, which is desirably carried out to process the alloy according to the present invention. The alloy is first solution-treated at a temperature between 1200° C. and 1300° C. The solutioned alloy is subjected to magnetic tempering at a temperature between 640° and 675° C. and thereafter to a tempering or aging stage at a temperature between 500° and 600° C. It is preferable to execute each of the magnetic tempering and aging stepwise at successively decreased temperatures in each temperature range. It should be noted that the solution-treatment may be carried out, depending upon the composition of the alloy, at a temperature much lower than 1200° C. and followed by a slow cooling without requiring quenching to shift to the magnetic tempering stage. FIG. 11 shows that the magnetic tempering is best carried out at a temperature of 670°±5° C. to render the alloy of the invention to exhibit, with good reproduction and stability, excellent magnetic properties, viz., a coercive force Hc of 650 Oe, a residual flux density Br of 14.5 KG and a maximum energy product (BH)max of 7.05 to 7.10 MG.Oe.

It should be noted that the alloy according to the invention contains relatively costly cobalt, vanadium and tangsten in a total amount of at most 18%. When cast, it is free from tendency to be broken and need not be columnarly crystallized or solidified. Moreover, it can be treated in solutioning at a sufficiently reduced temperature and permits working and machining even after its magnetic tempering stage and eventual magnetization.

Finally it should be understood that the alloy according to the invention does not exclude inclusion of any one or more known components such as silicon recognized to reduce the rate of cooling of the solutioned alloy, copper recognized to enhance magnetic properties and molybdenum, nickel, aluminum, and manganese proposed similarly earlier.

What is claimed is:

1. A spinodal decomposition type magnetic alloy consisting by weight essentially of 19 to 23% chromium, 10 to 18% cobalt, 0.5 to 4% vanadium, 0.3 to 3% titanium, 0.1 to 2.5% tungsten and the balance iron.

2. The alloy defined in claim 1 which contains 20 to 22% by weight chromium.

3. The alloy defined in claim 2 which contains about 21% chromium.

4. The alloy defined in claim 1 which contains 13 to 17% by weight cobalt.

5. The alloy defined in claim 4 which contains 15% by weight cobalt.

6. The alloy defined in claim 1 which contains 1 to 3% by weight vanadium.

7. The alloy defined in claim 6 which contains about 2% by weight vanadium.

8. The alloy defined in claim 1 which contains 0.2 to 2.0% tungsten.

9. The alloy defined in claim 8 which contains about 1% by weight tungsten.

10. The alloy defined in claim 1 which contains 1 to 2.2% titanium.

* * * * *